US012207687B2

(12) United States Patent
Jung et al.

(10) Patent No.: US 12,207,687 B2
(45) Date of Patent: Jan. 28, 2025

(54) AEROSOL GENERATING DEVICE AND METHOD OF CONTROLLING THE SAME

(71) Applicant: KT&G CORPORATION, Daejeon (KR)

(72) Inventors: Hyung Jin Jung, Seoul (KR); Tae Hun Kim, Yongin-si (KR); Hun Il Lim, Seoul (KR); Jae Sung Choi, Hanam-si (KR); Jung Ho Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 1111 days.

(21) Appl. No.: 16/979,585

(22) PCT Filed: Oct. 22, 2019

(86) PCT No.: PCT/KR2019/013867

§ 371 (c)(1),
(2) Date: Sep. 10, 2020

(87) PCT Pub. No.: WO2020/101198

PCT Pub. Date: May 22, 2020

(65) Prior Publication Data

US 2021/0000185 A1 Jan. 7, 2021

(30) Foreign Application Priority Data

Nov. 16, 2018 (KR) ..... 10-2018-0141968

(51) Int. Cl.
*A24F 40/57* (2020.01)
*A24F 40/20* (2020.01)
*A24F 40/51* (2020.01)

(52) U.S. Cl.
CPC ..... *A24F 40/57* (2020.01); *A24F 40/20* (2020.01); *A24F 40/51* (2020.01)

(58) Field of Classification Search
None
See application file for complete search history.

(56) References Cited

U.S. PATENT DOCUMENTS 10,624,393 B2 4/2020 Kuczaj
10,667,329 B2 5/2020 Bernauer et al.
(Continued)

FOREIGN PATENT DOCUMENTS

CN 103889258 A 6/2014
CN 104470386 A 3/2015
(Continued)

OTHER PUBLICATIONS

Communication dated Mar. 1, 2023 issued by the State Intellectual Party of the P.R.China in application No. 201980029202.x.
(Continued)

*Primary Examiner* — Cynthia Szewczyk
(74) *Attorney, Agent, or Firm* — Sughrue Mion, PLLC

(57) ABSTRACT

A method of controlling an aerosol generating device includes measuring a temperature of a heater, selecting one of a plurality of temperature correction algorithms, based on the measured temperature, and correcting the measured temperature by applying the selected temperature correction algorithm. In addition, a method of controlling an aerosol generating device includes measuring a temperature of a heater operating in an operation section including a plurality of sections, determining, from among the plurality of sections, a current section in which the heater is operating, selecting one of a plurality of temperature correction algorithms, based on the selected current section of the heater, and correcting the measured temperature of the heater by applying the selected temperature correction algorithm.

15 Claims, 10 Drawing Sheets

(56) References Cited

U.S. PATENT DOCUMENTS

| | | | | |
|---|---|---|---|---|
| 10,674,770 | B2 | 6/2020 | Talon | |
| 11,013,262 | B2 | 5/2021 | Reevell | |
| 2014/0299141 | A1 | 10/2014 | Flick | |
| 2016/0262454 | A1 | 9/2016 | Sears et al. | |
| 2017/0042243 | A1 | 2/2017 | Plojoux et al. | |
| 2017/0215478 | A1 | 8/2017 | Harrison et al. | |
| 2017/0238610 | A1 | 8/2017 | Reevell | |
| 2018/0084608 | A1 | 3/2018 | Bernauer et al. | |
| 2019/0246699 | A1 | 8/2019 | Qiu | |
| 2019/0313698 | A1 | 10/2019 | Kuczaj | |
| 2019/0342950 | A1 | 11/2019 | Bernauer et al. | |
| 2019/0380389 | A1 | 12/2019 | Hong et al. | |
| 2020/0086068 | A1 | 3/2020 | Lee et al. | |
| 2020/0237006 | A1* | 7/2020 | Akao ..... | H01M 10/48 |

FOREIGN PATENT DOCUMENTS

| | | | |
|---|---|---|---|
| CN | 106307614 | A | 1/2017 |
| CN | 106455708 | A | 2/2017 |
| CN | 107407941 | A | 11/2017 |
| CN | 107529828 | A | 1/2018 |
| CN | 108135287 | A | 6/2018 |
| CN | 108567174 | A | 9/2018 |
| EP | 2471392 | B1 | 9/2013 |
| KR | 10-2017-0013401 | A | 2/2017 |
| KR | 10-2017-0107518 | A | 9/2017 |
| KR | 10-1793802 | B1 | 11/2017 |
| KR | 10-2017-0137066 | A | 12/2017 |
| KR | 10-2018-0085365 | A | 7/2018 |
| KR | 10-2018-0111460 | A | 10/2018 |
| KR | 10-2018-0115681 | A | 10/2018 |
| WO | 2018/019786 | A1 | 2/2018 |
| WO | 2018135887 | A1 | 7/2018 |

OTHER PUBLICATIONS

Korean Intellectual Property Office Notice of Non-Final Rejection for KR 10-2018-0141968 dated Jun. 9, 2020.

International Search Report for PCT/KR2019/013867 dated Jan. 29, 2020 [PCT/ISA/210].

Extended European Search Report dated Jan. 4, 2022 in Application No. 19883701.5.

Communication issued May 18, 2021 by the Japanese Patent Office in application No. 2020-535998.

Chinese Office Action dated May 20, 2024 in Application No. 201980029202.X.

* cited by examiner

AEROSOL GENERATING DEVICE AND METHOD OF CONTROLLING THE SAME

CROSS REFERENCE TO RELATED APPLICATIONS

This application is a National Stage of International Application No. PCT/KR2019/013867 filed Oct. 22, 2019, claiming priority based on Korean Patent Application No. 10-2018-0141968 filed Nov. 16, 2018.

TECHNICAL FIELD

One or more embodiments of the present disclosure provide an aerosol generating device and a method of controlling the same.

BACKGROUND ART

Recently, there has been an increasing demand for an alternative method of overcoming the shortcomings of traditional cigarettes. For example, there is growing demand for a method of generating aerosol by heating an aerosol generating material, rather than by combusting a cigarette.

A smoking taste depends on the amount of heat applied to the aerosol generating material. When the aerosol generating material is heated by a heater, an aerosol generating device may control electric power supplied to the heater, based on a preset temperature profile, to provide a user with an optimal smoking taste.

However, even if the electric power supplied to the heater is controlled based on the preset temperature profile, a temperature of the heater and an actual temperature at which the aerosol generating material is heated may be different from each other. Therefore, there is need for a technique for accurately correcting the measured temperature of the heater to the actual temperature at which the aerosol generating material is heated.

DESCRIPTION OF EMBODIMENTS

Technical Problem

One or more embodiments of the present disclosure provide an aerosol generating device and a method of controlling the same. One or more embodiments of the present disclosure provide an aerosol generating device capable of dealing with a problem that the measured temperature of the heater and the actual temperature at which the aerosol generating material is heated are different from each other.

Embodiments of the present disclosure are not limited thereto. It is to be appreciated that other embodiments will be apparent to those skilled in the art from a consideration of the specification or practice of the present disclosure described herein.

Solution to Problem

A method of controlling an aerosol generating device includes measuring a temperature of a heater, selecting one of a plurality of temperature correction algorithms, based on the measured temperature, and correcting the measured temperature by applying the selected temperature correction algorithm.

In addition, a method of controlling an aerosol generating device includes measuring a temperature of a heater operating in an operation section including a plurality of sections, determining, from among the plurality of sections, a current section in which the heater is operating, selecting one of a plurality of temperature correction algorithms, based on the current section of the heater, and correcting the measured temperature by applying the selected temperature correction algorithm.

Advantageous Effects of Disclosure

According to embodiments of the present disclosure, a more accurate temperature correction may be made by correcting the measured temperature of the heater to the actual temperature at which the aerosol generating material is heated, based on at least one of the measured temperature of the heater and the current section in which the heater operates.

BEST MODE

Figure 1:
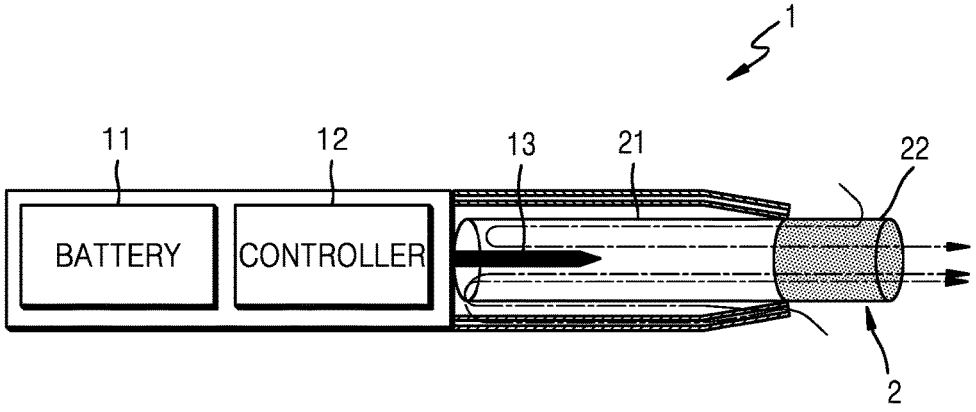
FIGS. 1 through 3 are diagrams showing examples in which a cigarette is inserted into an aerosol generating device.

According to an aspect of the present disclosure, a method of controlling an aerosol generating device includes: measuring a temperature of a heater; selecting one of a plurality of temperature correction algorithms, based on the measured temperature; and correcting the measured temperature by applying the selected temperature correction algorithm.

According to another aspect of the present disclosure, a method of controlling an aerosol generating device includes: measuring a temperature of a heater operating in an operation section including a plurality of sections; determining, from among the plurality of sections, a current section in which the heater is operating; selecting one of a plurality of temperature correction algorithms, based on the current section in which the heater is operating; and correcting the measured temperature by applying the selected temperature correction algorithm.

According to another aspect of the present disclosure, an aerosol generating device includes a heater for heating an aerosol generating material and a controller configured to measure a temperature of the heater, select one of a plurality of temperature correction algorithms based on the measured temperature, and correct the measured temperature by applying the selected temperature correction algorithm.

According to another aspect of the present disclosure, an aerosol generating device includes a heater for heating an aerosol generating material and a controller configured to measure a temperature of the heater operating in an operation section including a plurality of sections, select, from among the plurality of sections, a current section in which the heater is operating, select one of a plurality of temperature correction algorithms based on the current section, and correct the measured temperature by applying the selected temperature correction algorithm.

According to another aspect of the present disclosure, a computer-readable recording medium has recorded thereon a computer program for executing the method according to an aspect and another aspect of the present disclosure.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
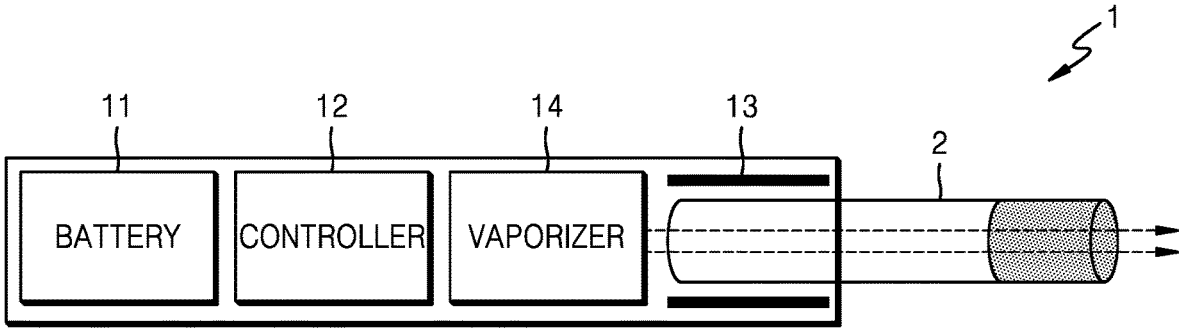
Figure 3:
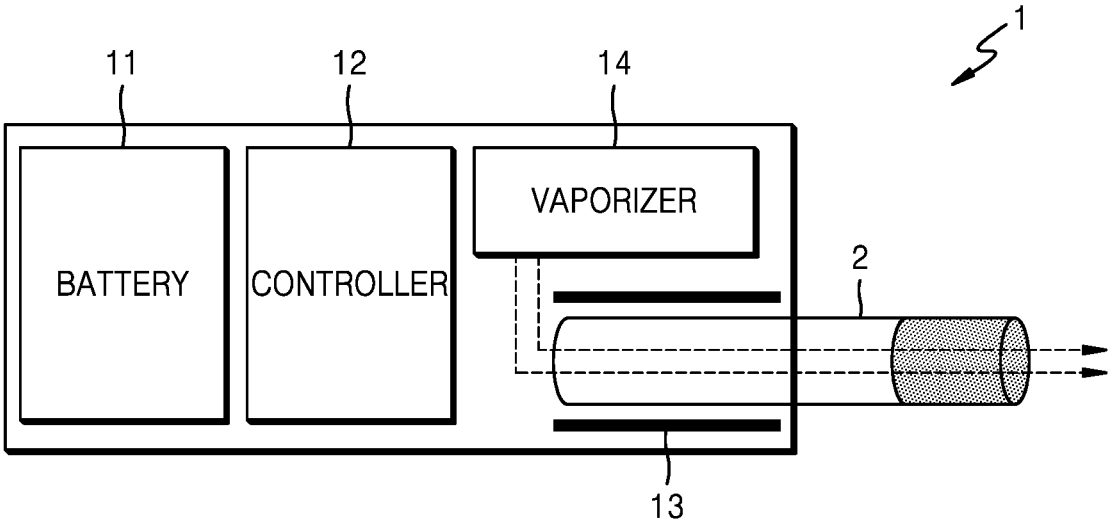

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, according to necessity, the heater 13 may be omitted.

FIG. 1 illustrates that the battery 11, the controller 12, and the heater 130 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate an aerosol from the cigarette 2 and/or the vaporizer 14. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may control overall operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated while the cradle and the aerosol generating device 1 are coupled to each other.

The cigarette 2 may be similar to a general combustive cigarette. For example, the cigarette 2 may be divided into a first portion including an aerosol generating material and a second portion including a filter, etc. The second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage formed may be controlled by the user. Accordingly, the amount and smoothness of vapor may be adjusted by the user. As another example, the external air may flow into the cigarette 2 through at least one hole formed in a surface of the cigarette 2.

Hereinafter, an example of the cigarette 2 will be described with reference to FIG. 4 and FIG. 5.

Figure 4:
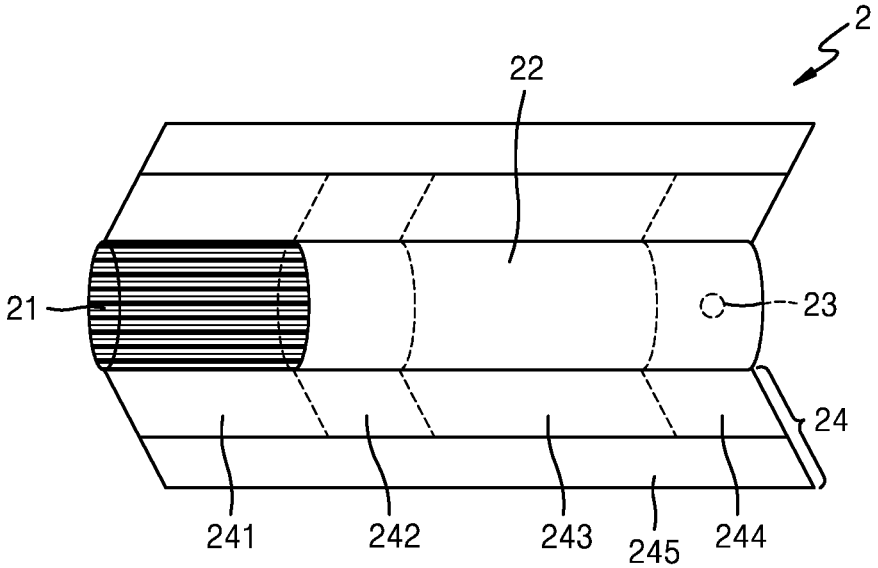
FIG. 4 and FIG. 5 illustrate an example of a cigarette.
Figure 5:
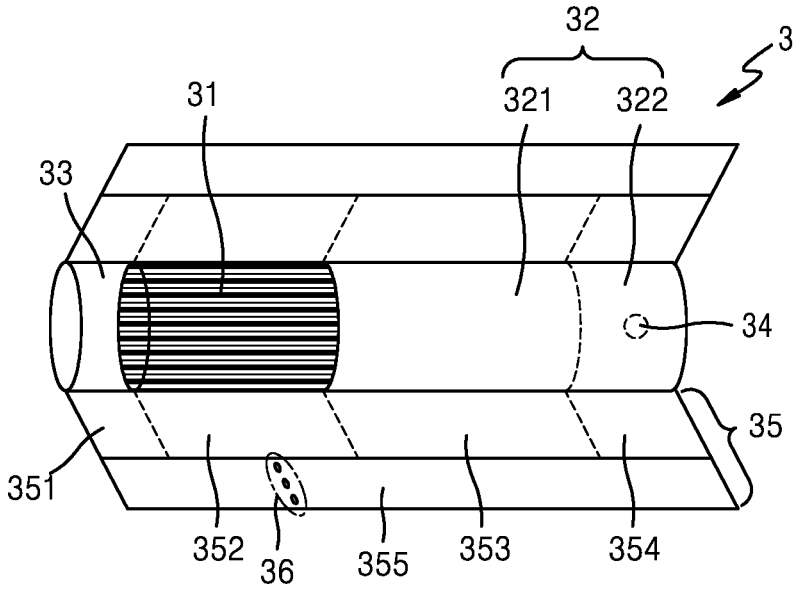

FIG. 4 and FIG. 5 illustrate an example of a cigarette.

Referring to FIG. 4, the cigarette 2 may include a tobacco rod 21 and a filter rod 22. The first portion 21 described above with reference to FIGS. 1 through 3 may include the tobacco rod, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, as necessary, the filter rod 22 may further include at least one segment configured to perform other functions.

The cigarette 2000 may be packaged by at least one wrapper 24. The wrapper 24 may have at least one hole through which external air may be introduced or internal air may be discharged. For example, the cigarette 2 may be packaged by one wrapper 24. As another example, the cigarette 2 may be doubly packaged by at least two wrappers 24. For example, the tobacco rod 21 may be packaged by a first wrapper 241, and the filter rod 22 may be packaged by wrappers 242, 243, 244. Also, the entire cigarette 2 may be packaged by a single wrapper 245. When the filter rod 22 includes a plurality of segments, each segment may be packaged by a separate wrapper 242, 243, 244.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

Referring to FIG. 5, the cigarette 3 according to an embodiment may further include a front-end filter 33. The front-end filter 33 may be located on a side of the tobacco rod 31, the side not facing the filter rod 32. The front-end filter 33 may prevent the tobacco rod 31 from being detached and prevent the liquefied aerosol from flowing into the aerosol generating device 1 (FIGS. 1 through 3) from the tobacco rod 31, during smoking.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

A diameter and a total length of the cigarette 3 may correspond to the diameter and the total length of the cigarette 2 of FIG. 4, respectively. For example, a length of the front-end plug 33 may be about 7 mm, a length of the tobacco rod 31 may be about 15 mm, a length of the first segment 321 may be about 12 mm, and a length of the second segment 322 may be about 14 mm. However, embodiments of the present disclosure are not limited thereto.

The cigarette 3 may be packaged by at least one wrapper 35. The wrapper 35 may include at least one hole through which air flows in from outside and gas flows out of the cigarette 3. For example, the front-end plug 33 may be packaged by a first wrapper 351, the tobacco rod 31 may be packaged by a second wrapper 352, the first segment 321 may be packaged by a third wrapper 353, and the second segment 322 may be packaged by a fourth wrapper 354. Finally, the cigarette 3 may be completely repackaged by a fifth wrapper 355.

The fifth wrapper 355 may include at least one perforation 36. For example, the perforation 36 may be formed in an area of the wrapper 35 wrapping the tobacco rod 31. However, embodiments of the present disclosure are not limited thereto. The perforation 36 may deliver heat generated by the heater 13 illustrated in FIGS. 2 and 3 into the tobacco rod 31.

The second segment 322 may include at least one capsule 34. Here, the capsule 34 may generate a flavor or aerosol. For example, the capsule 34 may have a structure in which a liquid containing a spice is wrapped by a film. The capsule 34 may be in a spherical or cylindrical shape. However, embodiments of the present disclosure are not limited thereto.

Figure 6:
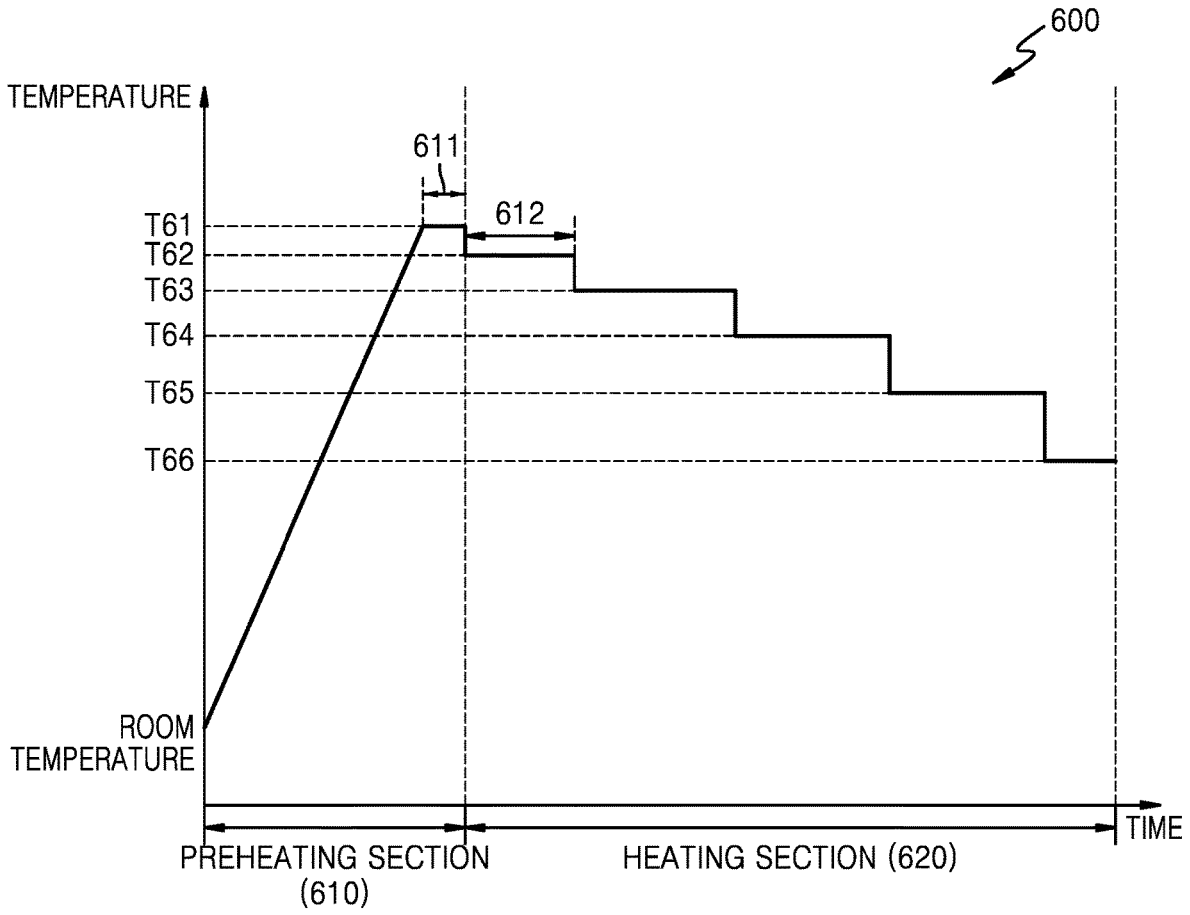
FIG. 6 is a diagram illustrating an example of a temperature profile of a heater according to an embodiment of the present disclosure.

FIG. 6 is a diagram illustrating an example of a temperature profile of a heater according to an embodiment of the present disclosure.

FIG. 6 illustrates a temperature profile 600 of a heater heating an aerosol generating material within an aerosol generating device. In an embodiment, the temperature profile 600 may be applied to the heater 13 heating the cigarette 2 illustrated in FIGS. 2 to 3. However, type of the heater and object that the heater heats are not limited thereto.

The temperature profile 600 of the heater may include a preheating section 610 and a heating section 620.

A temperature of the heater in the preheating section 610 may reach a preheating target temperature T61. For example, the preheating target temperature T61 may be between 200° C. to 250° C., and it is desirable that the preheating target temperature T61 be 230° C. Duration of the preheating section 610 may be 20 seconds to 40 seconds, and it is desirable that the duration of the preheating section 610 be 30 seconds.

The aerosol generating device may start the preheating section 610 upon receiving an input from a user. For example, the aerosol generating device may control electric power supplied to the heater based on a temperature profile of the preheating section 610 by receiving the input from the user pressing a button on the aerosol generating device.

In an embodiment, when the amount of heat generated by the heater during the preheating section 610 reaches a preset value, the aerosol generating device may end the preheating section 610. Referring to FIG. 6, if the temperature of the heater in the preheating section 610 reaches the preheating target temperature T61, but the amount of heat generated by the heater is below the preset value, the aerosol generating device may maintain the preheating section 610 for a certain period of time 611 until the amount of heat generated by the heater reaches the preset value.

In another embodiment, when the temperature of the heater reaches the preheating target temperature T 61, the aerosol generating device may end the preheating section 610.

However, criteria of the start and end of the preheating section 610 are not limited thereto.

When the preheating section 610 is completed, the aerosol generating device may notify the user of the completion of the preheating through a display or lamp outputting visual information, a motor outputting tactile information, a speaker outputting sound information, and the like.

The heating section 620 may be divided into a plurality of sections. The aerosol generating device may control electric power supplied to the heater such that the temperature of the heater is maintained at a preset temperature (T62 to T 66) corresponding to each of the plurality of sections.

In an embodiment, the preset temperature (T62 to T 66) corresponding to each of the plurality of sections may be between 100° C. to 200° C. In an embodiment, the preset temperature (T62 to T 66) corresponding to each of the plurality of sections may be set to be gradually lowered as operation time of the heater increases. Alternatively, as the operation time of the heater increases, the preset temperature (T62 to T 66) corresponding to each of the plurality of sections may be set to be raised and lowered alternately or may be set to be gradually lowered and then raised again.

The duration of the heating section 620 may be three minutes to five minutes, and it is desirable that the duration of the heating section 620 be four minutes. The duration of each of the plurality of sections constituting the heating section 620 may be five seconds to two seconds, and the durations of at least some of the plurality of sections may be set to be identical to each other or different from each other.

When the preheating section 610 is completed, the aerosol generating device may control electric power supplied to the heater, based on the temperature profile of the heating section 620. In an embodiment, the aerosol generating device may control electric power supplied to the heater such that the temperature of the heater at a start section 612 of the heating section 620 is maintained at T62 lower than the preheating target temperature T61. Following that, the aerosol generating device may control electric power supplied to the heater such that the temperature of the heater is maintained at the preset temperature (T62 to T 66) corresponding to each of the plurality of sections. When a preset period of time elapses following the start of the heating section 620, the aerosol generating device may cut off electric power supplied to the heater.

On the other hand, even before the preset period of time elapses following the start of the heating section 620, if the number of puffs of a user counted by the aerosol generating device reaches a preset number, the aerosol generating device may cut off electric power supplied to the heater.

Figure 7:
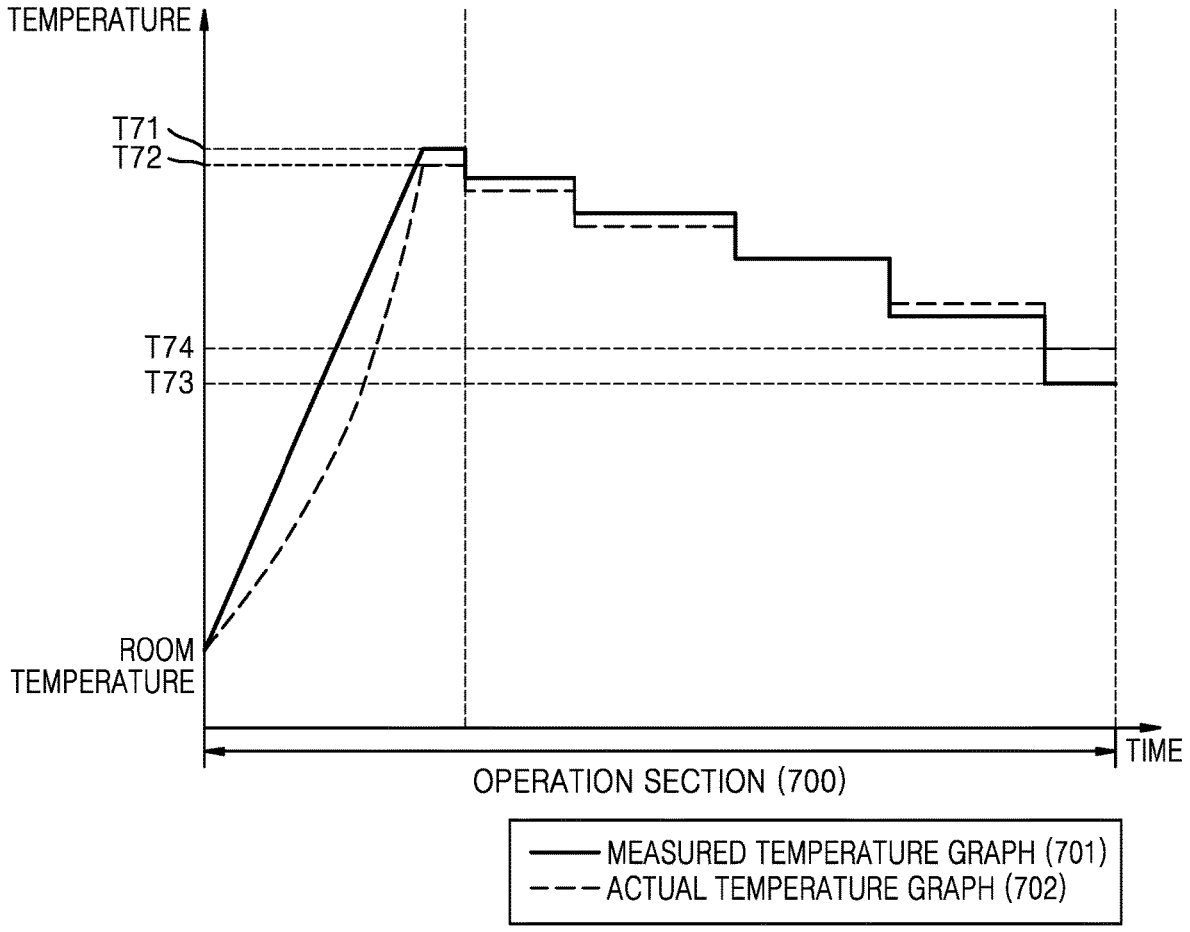
FIG. 7 is a diagram illustrating an example of a graph of measured temperature of a heater in an operation section and a graph of actual temperature according to an embodiment of the present disclosure.

FIG. 7 is a diagram illustrating an example of a graph of measured temperature of a heater in an operation section and a graph of actual temperature according to an embodiment of the present disclosure.

An aerosol generating device may be provided with a temperature detection sensor. The aerosol generating device may be provided with a separate temperature detection sensor, or the heater may function as a temperature detection sensor.

In an embodiment, a heater assembly may include a heater and a heat transfer object. The heater is a heat source generating heat, and the heat transfer object may transfer heat generated by the heater to an aerosol generating material.

For example, the heater may be made into a film shape including an electrical resistive pattern and the film-shaped heater may be arranged to surround at least a portion of an outer surface of the heat transfer object (for example, a heat transfer tube). The heat transfer tube may include a metal material capable of transferring heat, such as aluminum or stainless steel, an alloy material, carbon, a ceramic material, and the like. When electric power is supplied to the electrical resistive pattern of the heater, heat is generated, and the generated heat may heat the aerosol generating material through the heat transfer tube.

In the case of a heater indirectly heating the aerosol generating material, using the heat transfer object (for example, the heat transfer tube), a measured temperature of the temperature detection sensor may be different from an actual temperature at which the aerosol generating material is heated.

For example, in a temperature rise process, a temperature of the heat transfer tube may rise slowly, so the measured temperature of the temperature detection sensor may be higher than the actual temperature at which the aerosol generating material is heated. On the other hand, in a temperature drop process, because of residual heat present in the heat transfer tube, the measured temperature of the temperature detection sensor may be lower than the actual temperature at which the aerosol generating material is heated.

In an embodiment, the aerosol generating device may control electric power supplied to the heater, based on the temperature profile 600 of FIG. 6. FIG. 7 illustrates a graph of measured temperature 701 of the heater measured by the temperature detection sensor at an operation section 700 in which the heater operates based on the temperature profile 600 and a graph of actual temperature 702 at which the aerosol generating material is heated.

A temperature difference between the graph of measured temperature 701 and the graph of actual temperature 702 may vary according to a section in which the heater operates and the measured temperature of the heater. For example, in the temperature rise process, a measured temperature T71 may be higher than an actual temperature T72. In contrast, in the temperature drop process, a measured temperature T73 may be lower than an actual temperature T74. A temperature difference T72-T71 between the actual temperature T72 and the measured temperature T71 in the temperature rise process may be different from a temperature difference T74-T73 between the actual temperature T74 and the measured temperature T73 in the temperature drop process.

A smoking taste depends on the amount of heat applied to the aerosol generating material. The aerosol generating device may control electric power supplied to the heater based on a preset temperature profile to provide a user with an optimal smoking taste. However, as described above, since the measured temperature of the heater measured using the temperature detection sensor and the actual temperature at which the aerosol generating material is heated are different from each other, the aerosol generating device may correct the measured temperature of the heater to match the measured temperature with the actual temperature.

The temperature difference between the measured temperature and the actual temperature may vary according to the section, the measured temperature of the heater, and the like. Therefore, a plurality of temperature correction algorithms may be used for more accurate temperature correction in embodiments of the present disclosure.

Figure 8:
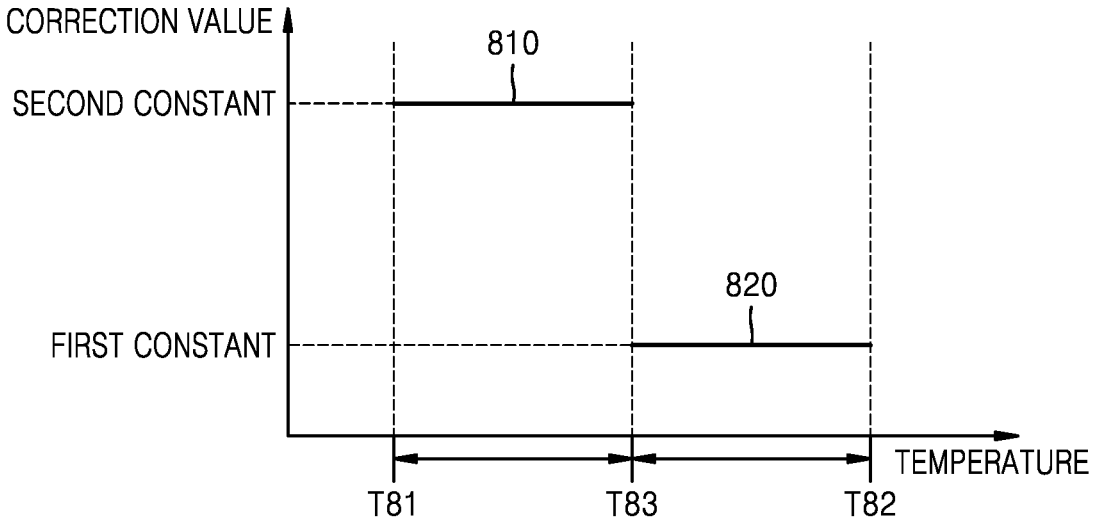
FIG. 8 is a diagram illustrating a temperature correction algorithm according to an embodiment of the present disclosure.

FIG. 8 is a diagram illustrating a temperature correction algorithm according to an embodiment of the present disclosure.

An aerosol generating device may include a temperature detection sensor. The aerosol generating device may be provided with a separate temperature detection sensor, or a heater may function as a temperature detection sensor.

The aerosol generating device may measure a temperature of the heater, using the temperature detection sensor. The aerosol generating device may select one of a plurality of temperature correction algorithms, based on the measured temperature. The aerosol generating device may correct the measured temperature by applying the selected temperature correction algorithm.

Referring to FIG. 8, the plurality of temperature correction algorithms may include a high-temperature correction algorithm 810 and a low-temperature correction algorithm 820.

When the measured temperature of the heater is equal to or greater than a preset value T83, the aerosol generating device may correct the measured temperature by applying the high-temperature correction algorithm 810. When the measured temperature of the heater is below the preset value T83, the aerosol generating device may correct the measured temperature by applying the low-temperature correction algorithm 820.

The preset value T83 may be between a low temperature limit value T81 and a high temperature limit value T82. For example, when the low temperature limit value T81 is 50° C. and the high temperature limit value T82 is 250° C., the preset value T83 may be 150° C., which is an intermediate value of the low temperature limit value T81 and the high temperature limit value T82. However, method of setting the preset value T83 is not limited thereto.

In an embodiment, a high-temperature correction algorithm and a low-temperature correction algorithm may be represented by a polynomial or a constant. For example, referring to FIG. 8, the high-temperature correction algorithm 810 may add a first constant to the measured temperature of the heater, and the low-temperature correction algorithm 820 may add a second constant to the measured temperature of the heater.

The first constant and the second constant may be a positive real number, zero, or a negative real number. Describing with reference to FIG. 7, for example, since the temperature difference T72−T71 between the actual temperature T72 and the measured temperature T71 needs to be added to the measured temperature T71 to correct the measured temperature T71, the first constant corresponding to the high-temperature correction algorithm 810 is a negative real number. In addition, since the temperature difference T74−T73 between the actual temperature T74 and the measured temperature T73 needs to be added to the measured temperature T73 to correct the measured temperature T73, the second constant corresponding to the low-temperature correction algorithm 820 is a positive real number. The absolute value of the first constant is less than the absolute value of the second constant.

Figure 9:
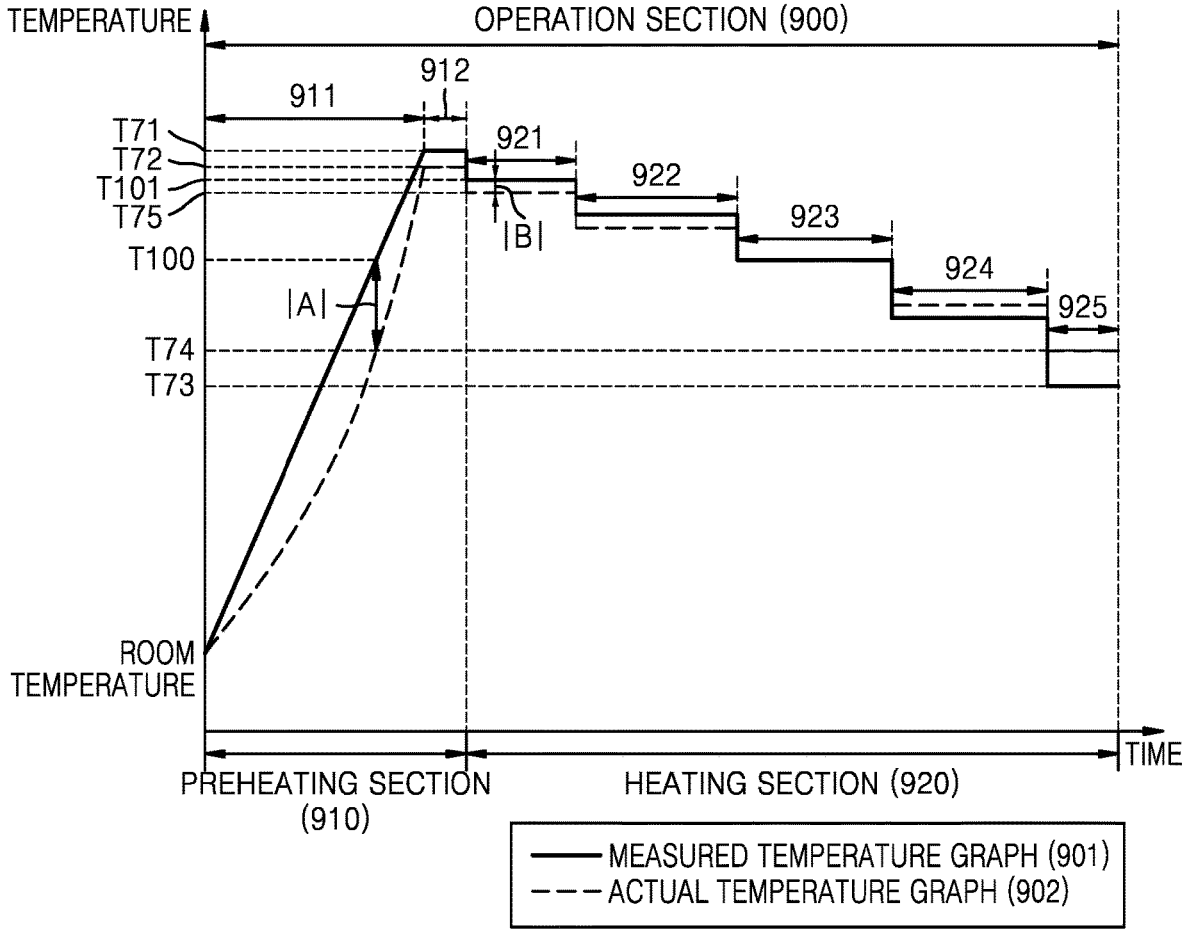
FIG. 9 is a diagram illustrating an example of a graph of measured temperature of a heater in an operation section and a graph of actual temperature according to another embodiment of the present disclosure.

FIG. 9 is a diagram illustrating an example of a graph of measured temperature of a heater in an operation section and a graph of actual temperature according to another embodiment of the present disclosure.

FIG. 9 illustrates a graph of measured temperature 901 of the heater measured by a temperature detection sensor of an aerosol generating device and a graph of actual temperature 902 at which an aerosol generating material is heated.

An operation section 900 in which the heater is operating may include a preheating section 910 and a heating section 920. The preheating section 910 may include a first preheating section 911 and a second preheating section 912, and the heating section 920 may include a first heating section 921 to a fifth heating section 925.

Figure 10A:
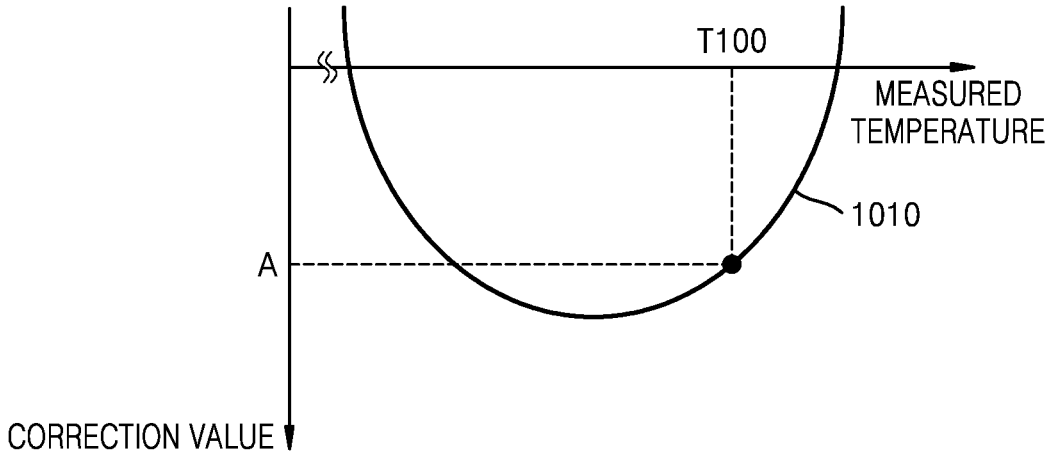
FIGS. 10A to 10C are diagrams illustrating a temperature correction algorithm according to an embodiment of the present disclosure.
Figure 10B:
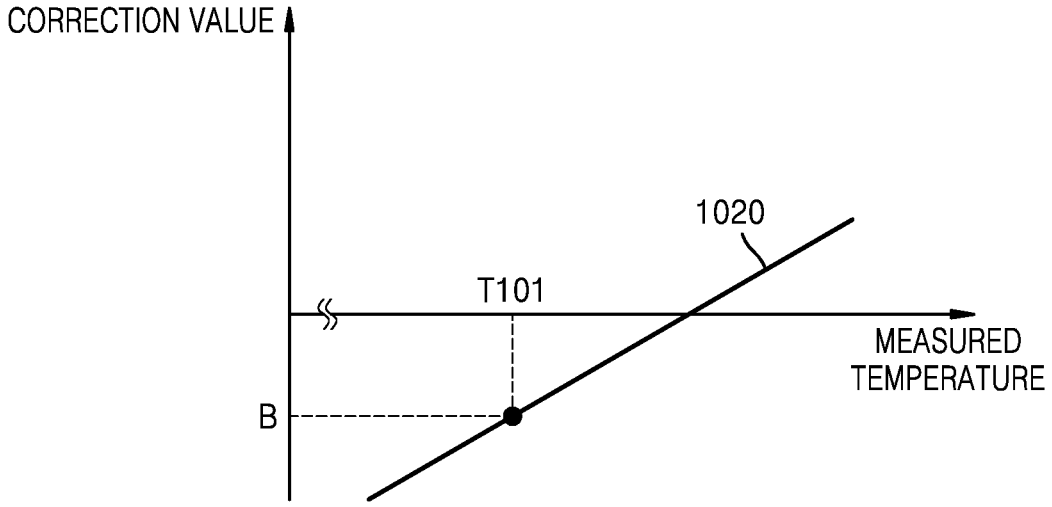
Figure 10C:
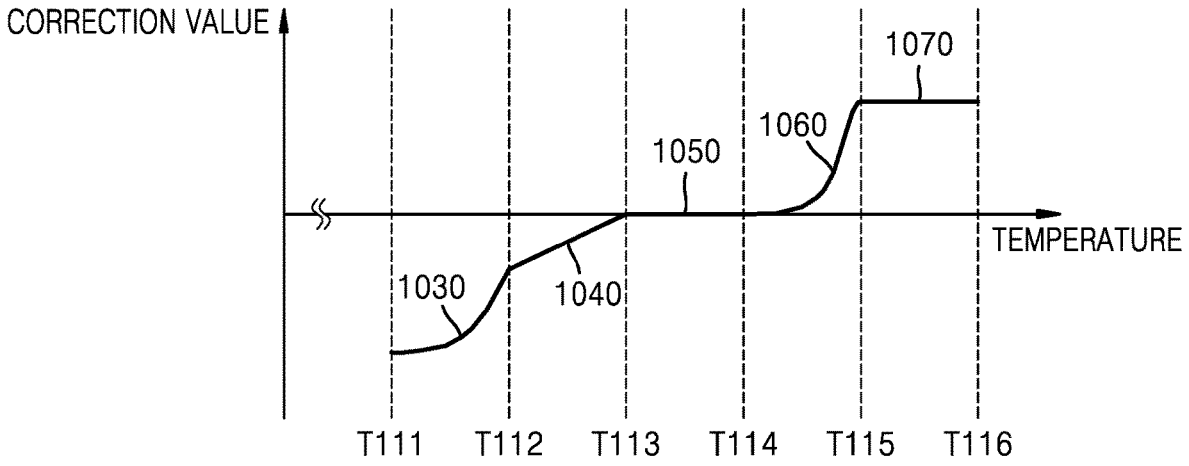

FIGS. 10A to 10C are diagrams illustrating a temperature correction algorithm according to an embodiment of the present disclosure.

An aerosol generating device may measure a temperature of a heater operating in an operation section including a plurality of sections. The aerosol generating device may determine, from among the plurality of sections, a current section in which the heater is currently operating. The aerosol generating device may select one of a plurality of temperature correction algorithms, based on the current section in which the heater is currently operating. The aerosol generating device may correct the measured temperature by applying the selected temperature correction algorithm.

Referring to FIG. 9, the operation section 900 in which the heater is operating may include the preheating section 910 and the heating section 920. The aerosol generating device may determine whether the heater is currently operating in the preheating section 910 or in the heating section 920.

If the heater is operating in the preheating section 910, the aerosol generating device may apply a preheating section temperature correction algorithm to the measured temperature of the heater. If the heater is operating in the heating section 920, the aerosol generating device may apply a heating section temperature correction algorithm to the measured temperature of the heater.

FIG. 10A illustrates a graph corresponding to a preheating section temperature correction algorithm 1010 applied to the measured temperature of the heater when the current section in which the heater is operating corresponds to the preheating section 910.

The preheating section temperature correction algorithm 1010 may be determined based on the temperature difference between the measured temperature graph 901 and the actual temperature graph 902 in the preheating section 910. The preheating section temperature correction algorithm 1010 may be a polynomial or a constant.

When the temperature difference between the measured temperature graph 901 and the actual temperature graph 902 in the preheating section 910 is as shown in FIG. 9, the preheating section temperature correction algorithm 1010 may be a polynomial. In that case, when the measured temperature of the heater measured by a temperature detection sensor of the aerosol generating device is T100 in the preheating section 901, the aerosol generating device may add a correction value 'A' to the measured temperature T100 by applying the preheating section temperature correction algorithm 1010 to correct the measured temperature T100 to T74.

FIG. 10B illustrates a graph corresponding to a heating section temperature correction algorithm 1020 applied to the measured temperature of the heater when the current section in which the heater is operating corresponds to the heating section 920.

The heating section temperature correction algorithm 1020 may be determined based on the temperature difference between the graph of measured temperature 901 and the graph of actual temperature 902 in the heating section 920. The heating section temperature correction algorithm 1020 may be a polynomial or a constant.

In an embodiment, the heating section temperature correction algorithm 1020 may be represented by a linear function determined based on the temperature difference T72-T71 between the actual temperature T72 and the measured temperature T71 in the first heating section 921, which is a heating start section, and the temperature difference T74-T73 between the actual temperature T74 and the measured temperature T73 in the fifth heating section 925, which is a heating completion section. In that case, when the measured temperature of the heater measured by the temperature detection sensor of the aerosol generating device is T101, the aerosol generating device may add a correction value 'B' to the measured temperature T101 by applying the heating section temperature correction algorithm 1020 to correct the measured temperature T101 to T75.

FIG. 10C illustrates a graph corresponding to a plurality of heating section temperature correction algorithms 1030 to 1070 applied to the measured temperature of the heater when the current section in which the heater is operating corresponds to the heating section 920.

In an embodiment, the heating section temperature correction algorithms 1030 to 1070 may be set differently for the first heating section 921 to the fifth heating section 925. The aerosol generating device may determine which of the first heating section 921 to the fifth heating section 925 is the current section in which the heater is operating, and may apply a heating section temperature correction algorithm corresponding to the determined heating section to correct the measured temperature of the heater.

Referring to FIG. 10C, the first heating section algorithm 1030 and the fourth heating section algorithm 1060 may be a polynomial of degree 2 or greater, the second heating section algorithm 1040 may be a linear function, and the third heating section algorithm 1050 and the fifth heating section algorithm 1070 may be constants.

The preheating section 910 may be also divided into a plurality of preheating sections, and the aerosol generating device may determine which of the plurality of preheating sections corresponds to the current section in which the heater is operating. Following that, the aerosol generating device may apply a preheating section temperature correction algorithm corresponding to the determined preheating section to correct the measured temperature of the heater.

Temperature correction algorithms illustrated in FIGS. 10A to 10C are merely examples, and embodiments of the present disclosure are not limited thereto. Various types of temperature correction algorithms may be used based on the temperature difference between the measured temperature of the heater measured by the temperature detection sensor of the aerosol generating device and the actual temperature at which the aerosol generating material is heated.

As described above with reference to FIG. 7, the heater assembly may include the heater generating heat (the electrical resistive pattern) and the heat transfer object (for example, the heat transfer tube) transferring the heat generated by the heater to the aerosol generating material. In that case, since heat capacity of the heater and of the heat transfer object is different from each other, the temperature rising/dropping rate of the heater and of the heat transfer object may be different from each other, and accordingly, the measured temperature of the heater measured by the temperature detection sensor and the actual temperature at which the aerosol generating material is heated by the heat transfer object may be different from each other.

In an embodiment, the measured temperature measured by the temperature detection sensor may be determined by a resistance value of the temperature detection sensor, and the actual temperature at which the aerosol generating material is heated may be determined by an infrared (IR) sensor measuring a temperature of a surface of the heat transfer object. However, methods of determining the measured temperature of the temperature detection sensor and the actual temperature at which the aerosol generating material is heated are not limited thereto.

The plurality of temperature correction algorithms determined based on the difference between the measured temperature and the actual temperature may be stored in the aerosol generating device in advance. In addition, the aerosol generating device may calculate the plurality of temperature correction algorithms in real time. The aerosol generating device may select one of the plurality of temperature correction algorithms already stored therein based on the measured temperature of the heater measured by the temperature detection sensor, the current section in which the heater is operating, and the like, and apply the selected temperature correction algorithm to correct the measured temperature.

The difference may be generated between the measured temperature and the actual temperature due to a variety of reasons, and the temperature difference may vary according to the measured temperature of the heater, the current section in which the heater is operating, and the like. In embodiments of the present disclosure, the plurality of temperature correction algorithms are used for more accurate temperature correction, and in particular, a temperature correction algorithm capable of correcting more accurately the measured temperature to the actual temperature may be selected based on at least one of the measured temperature of the heater and the current section in which the heater is operating.

Figure 11:
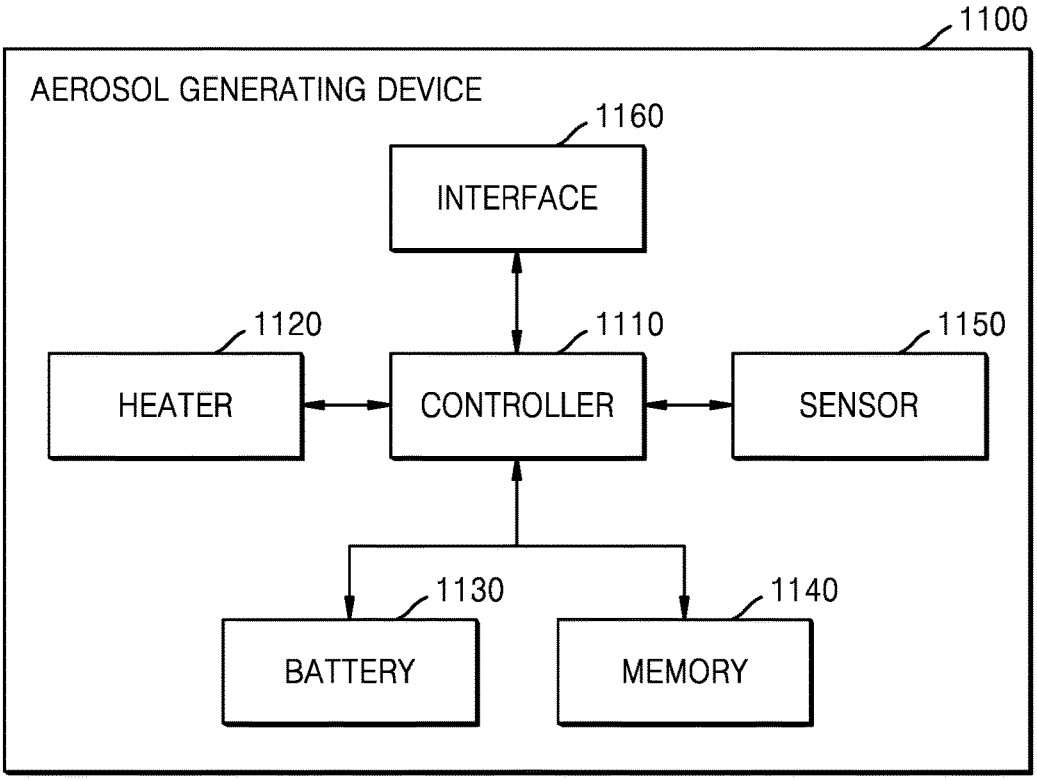
FIG. 11 is a block diagram illustrating a hardware configuration of an aerosol generating device according to an embodiment of the present disclosure.

FIG. 11 is a block diagram illustrating a hardware configuration of an aerosol generating device according to an embodiment of the present disclosure.

Referring to FIG. 11, an aerosol generating device 1100 may include a controller 1110, a heater 1120, a battery 1130, a memory 1140, a sensor 1150 and an interface 1160.

The heater 1120 is electrically heated by electric power supplied by the battery 1130, under the control of the controller 1110. The heater 1120 is arranged within an accommodation passage of the aerosol generating device 1100 accommodating a cigarette. As the cigarette is inserted through an insertion hole of the aerosol generating device 1100 from outside and then moved along the accommodation passage, one end portion of the cigarette may be inserted into the heater 1120. Thereby, the heated heater 1120 may raise a temperature of an aerosol generating material in the cigarette. The heater 1120 may be in any shape capable of being inserted into the cigarette.

The heater 1120 may include a heat source and a heat transfer object. For example, the heat source of the heater 1120 may be made into a film shape including an electrical resistive pattern, and the film-shaped heater 1120 may be arranged to surround at least a portion of an outer surface of the heat transfer object (for example, a heat transfer tube).

The heat transfer tube may include a metal material capable of transferring heat, such as aluminum, stainless steel, an alloy material, carbon, a ceramic material, or the like. When electric power is supplied to the electrical resistive pattern of the heater 1120, heat is generated, and the generated heat may heat the aerosol generating material through the heat transfer tube.

The aerosol generating device 1100 may include a separate temperature detection sensor. Alternatively, the heater 1120 may function as a temperature detection sensor instead of a separate temperature detection sensor. Alternatively, while the heater 1120 functions as a temperature detection sensor, the aerosol generating device 1100 may be further provided with a separate temperature detection sensor. The temperature detection sensor may be arranged on the heater 1120 in the form of a conductive track or a device.

Once voltage applied to the temperature detection sensor and current flowing through the temperature detection sensor are measured, resistance R may be determined. In that case, the temperature detection sensor may measure a temperature T by Equation 1 below.

$$R=R_0\{1+\alpha(T-T_0)\} \quad \text{[Equation 1]}$$

In Equation 1, R denotes a current resistance value of the temperature detection sensor, R0 denotes a resistance value at the temperature T0 (for example, 0° C.), and α denotes a resistance temperature coefficient of the temperature detection sensor. Since a conductive material (for example, metal) has an intrinsic resistance temperature coefficient, α may be predetermined according to the conductive material constituting the temperature detection sensor. Thus, once the resistance R of the temperature detection sensor is determined, the temperature T of the temperature detection sensor may be calculated by Equation 1 above.

The controller 1110 is hardware controlling the overall operation of the aerosol generating device 1100. The controller 1110 may include an integrated circuit implemented with a processing unit, such as a microprocessor, a microcontroller, and the like.

The controller 1110 analyzes a sensing result from the sensor 1150 and controls processes to be executed subsequently. The controller 1110 may start or suspend electric power supply to the heater 1120 from the battery 1130 according to the sensing result. In addition, the controller 1110 may control the amount of electric power supplied to the heater 1120 and the time at which the electric power is supplied to the heater 1120 for the heater 1120 to be heated to a certain temperature or to maintain an appropriate temperature. Moreover, the controller 1110 may process a variety of input data and output data of the interface 1160.

Furthermore, the controller 1110 may count the number of puffs of a user using the aerosol generating device 1100 and control related functions of the aerosol generating device 1100 to limit the user's smoking according to the counted number.

The memory 1140 is hardware for storing various types of data being processed within the aerosol generating device 1100 and may store data processed and data to be processed within the controller 1110. The memory 1140 may be implemented with various types of memory, such as random access memory (RAM) including dynamic random access memory (DRAM), static random access memory (SRAM), and the like, read-only memory (ROM), electrically erasable programmable read-only memory (EEPROM), and the like.

The memory 1140 may store data on the user's smoking pattern, such as smoking time, the frequency of smoking, and the like. The memory 1140 may also store data related to a reference temperature change value of the case where the cigarette is accommodated in the accommodation passage.

The memory 1140 may also store a plurality of temperature correction algorithms.

The battery 1130 supplies electric power used for operation of the aerosol generating device 1100. In other words, the battery 1130 may supply electric power for the heater 1120 to be heated. The battery 1130 may also supply electric power needed for the operation of other hardware, the controller 1110, the sensor 1150, and the interface 1160 provided within the aerosol generating device 1100. The battery 1130 may include a lithium iron phosphate (LiFePO4) battery. However, embodiments of the present disclosure are not limited thereto. The battery 1140 may be made of a lithium cobalt oxide (LiCoO2) battery, a lithium titanate battery, and the like. The battery 1130 may include a rechargeable battery or a disposable battery.

The sensor 1150 may include various types of sensors, such as a puff detection sensor (a temperature detection sensor, a flow detection sensor, a position detection sensor, and the like), a cigarette insertion detection sensor, a temperature detection sensor of a heater, and the like. A sensing result by the sensor 1150 is transmitted to the controller 1110, and the controller 1110 may control the aerosol generating device 1100 to execute a variety of functions, such as control of a heater temperature, restriction of smoking, determination of whether or not the cigarette is inserted, notification display, and the like according to the sensing result.

The interface 1160 may include a variety of interfacing means, such as a display or lamp for outputting visual information, a motor for outputting tactile information, a speaker for outputting sound information, terminals for communicating data with input/output (I/O) interfacing means (for example, a button or a touchscreen) receiving input information from a user or outputting information to the user or for receiving charged electric power, a communication interfacing module for communicating wirelessly with an external device (for example, Wi-Fi, Wi-Fi direct, Bluetooth, near-field communication (NFC), and the like), and the like. However, the aerosol generating device 1100 may be implemented by selecting only some of the various interfacing means described above.

The aerosol generating device 1100 may further include a vaporizer (not shown). The vaporizer (not shown) may include a liquid storage, a liquid delivery element, and a heating element for heating a liquid.

The liquid storage may store a liquid composition. For example, the liquid composition may include a liquid containing a tobacco-containing material containing a volatile tobacco flavor component, or a liquid containing a non-tobacco material. The liquid storage may be manufactured to be attached to/detached from the vaporizer (not shown) or may be manufactured integrally with the vaporizer (not shown).

For example, the liquid composition may include water, solvents, ethanol, plant extracts, spices, flavorings, or vitamin mixtures. The spices may include menthol, peppermint, spearmint oil, various fruit-flavored ingredients, and the like. However, embodiments of the present disclosure are not limited thereto. The flavorings may include ingredients capable of providing the user with various flavors or tastes. Vitamin mixtures may include a mixture of at least one of vitamin A, vitamin B, vitamin C, and vitamin E. However, embodiments of the present disclosure are not limited thereto. In addition, the liquid composition may include an aerosol forming agent, such as glycerin and propylene glycol.

The liquid delivery element may deliver the liquid composition of the liquid storage to the heating element. For example, the liquid delivery element may include a wick, such as cotton fiber, ceramic fiber, glass fiber, or porous ceramic. However, embodiments of the present disclosure are not limited thereto.

The heating element is an element for heating the liquid composition delivered by the liquid delivery element. For example, the heating element may include a metal heating wire, a metal hot plate, a ceramic heater, or the like. However, embodiments of the present disclosure are not limited thereto. The heating element may include a conductive filament, such as a nichrome wire and may be positioned as being wound around the liquid delivery element. The heating element may be heated by a current supply and may transfer heat to the liquid composition in contact with the heating element, thereby heating the liquid composition. As a result, an aerosol may be generated.

For example, the vaporizer (not shown) may be referred to as a cartomizer or an atomizer. However, embodiments of the present disclosure are not limited thereto.

Figure 12:
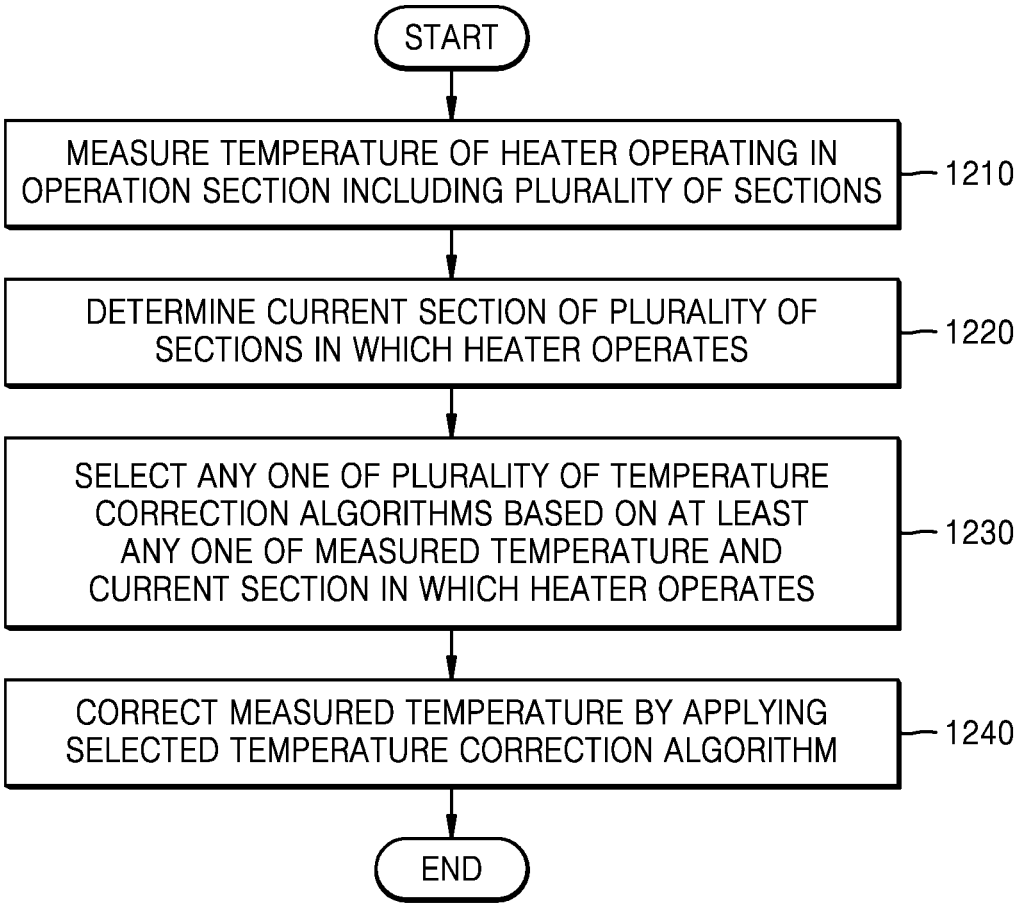
FIG. 12 is a flowchart of a method of controlling an aerosol generating device according to an embodiment of the present disclosure.

FIG. 12 is a flowchart of a method of controlling an aerosol generating device according to an embodiment of the present disclosure.

Referring to FIG. 12, the aerosol generating device may measure a temperature of a heater operating in an operation section including a plurality of sections, in operation 1210.

The aerosol generating device may include a temperature detection sensor. The aerosol generating device may be provided with a separate temperature detection sensor, or the heater may function as a temperature detection sensor. In an embodiment, the temperature detection sensor may measure the temperature of the heater, based on a change in a resistance value.

The aerosol generating device may determine, from among the plurality of sections, a current section in which the heater is operating, in operation 1220.

In an embodiment, the operation section of the heater may include a preheating section and a heating section. The preheating section and the heating section each may be divided into a plurality of sections.

The aerosol generating device may select one of a plurality of temperature correction algorithms, based on at least one of the measured temperature and the current section in which the heater is operating, in operation 1230.

In an embodiment, the aerosol generating device may select one of the plurality of temperature correction algorithms, based on the measured temperature. For example, when the measured temperature is equal to or greater than a preset value, the aerosol generating device may correct the measured temperature by applying a high-temperature correction algorithm. In contrast, when the measured temperature is below the preset value, the aerosol generating device may correct the measured temperature by applying a low-temperature correction algorithm. Alternatively, the aerosol generating device may select any one of three or more temperature correction algorithms, based on the measured temperature.

In the case where the aerosol generating device selects one of the plurality of temperature correction algorithms based solely on the measured temperature, operation 1220 may be omitted.

In another embodiment, the aerosol generating device may select one of the plurality of temperature correction algorithms based on the current section in which the heater is operating.

For example, the aerosol generating device may determine whether the current section in which the heater is operating corresponds to the preheating section or the heating section. If the current section in which the heater is operating corresponds to the preheating section, the aerosol generating device may correct the measured temperature by applying a preheating section temperature correction algorithm. If the current section in which the heater is operating corresponds to the heating section, the aerosol generating device may correct the measured temperature by applying a heating section temperature correction algorithm.

In another embodiment, the aerosol generating device may select one of the plurality of temperature correction algorithms, based on the measured temperature and the current section in which the heater is operating. In that case, the preheating section temperature correction algorithm and a plurality of heating section temperature correction algorithms may be included in the plurality of temperature correction algorithms.

For example, if the current section in which the heater is operating corresponds to the preheating section, the aerosol generating device may correct the measured temperature by applying the preheating section temperature correction algorithm. If the current section in which the heater is operating corresponds to one of a plurality of heating sections, the aerosol generating device may select one of the plurality of heating section temperature correction algorithms based on the measured temperature, and apply the selected heating section temperature correction algorithm to correct the measured temperature.

A plurality of preheating section temperature correction algorithms may be included in the plurality of temperature correction algorithms.

The aerosol generating device may correct the measured temperature by applying the selected temperature correction algorithm, in operation 1240.

In an embodiment, the measured temperature measured by the temperature detection sensor may be determined based on a resistance value of the temperature detection sensor, and an actual temperature at which an aerosol generating material is heated may be determined by an IR sensor remotely measuring a temperature of a surface of a heat transfer object.

The plurality of temperature correction algorithms determined based on a difference between the measured temperature and the actual temperature may be pre-stored in the aerosol generating device. The aerosol generating device may select one of the plurality of temperature correction algorithms stored therein based on at least one of the measured temperature of the heater measured by the temperature detection sensor and the current section in which the heater is operating, and apply the selected temperature correction algorithm to correct the measured temperature.

The temperature correction algorithm may be represented by a polynomial and a constant.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. A method of controlling an aerosol generating device, the method comprising:

measuring a temperature of a heater;

selecting one of a plurality of temperature correction algorithms, based on the measured temperature;

correcting the measured temperature by applying the selected temperature correction algorithm so that the measured temperature matches with an actual temperature at which an aerosol generating material is heated; and controlling power supplied to the heater based on the corrected temperature, wherein the plurality of temperature correction algorithms include a high-temperature correction algorithm and a low-temperature correction algorithm, and wherein the correcting of the measured temperature comprises correcting the measured temperature by applying the high-temperature correction algorithm based on the measured temperature being equal to or greater than a preset value, and correcting the measured temperature by applying the low-temperature correction algorithm based on the measured temperature being below the preset value.

2. The method of claim 1, wherein the high-temperature correction algorithm adds a first constant to the measured temperature, and the low-temperature correction algorithm adds a second constant to the measured temperature.

3. The method of claim 2, wherein an absolute value of the first constant is less than an absolute value of the second constant.

4. The method of claim 1, wherein heat generated from the heater is transferred to the aerosol generating material through a heat transfer object, and the plurality of temperature correction algorithms are determined based on a difference between the temperature of the heater and a temperature of the heat transfer object.

5. The method of claim 1, wherein the plurality of temperature correction algorithms are represented by a polynomial or a constant.

6. A method of controlling an aerosol generating device, the method comprising:

measuring a temperature of a heater operating in an operation section including a plurality of sections;

determining, from among the plurality of sections, a current section in which the heater is operating;

selecting one of a plurality of temperature correction algorithms, based on the current section in which the heater is operating;

correcting the measured temperature by applying the selected temperature correction algorithm so that the measured temperature matches with an actual temperature at which an aerosol generating material is heated; and controlling power supplied to the heater based on the corrected temperature, wherein the plurality of sections include a preheating section and a heating section, and the plurality of temperature correction algorithms include a preheating section temperature correction algorithm and a heating section temperature correction algorithm, and wherein the correcting of the measured temperature comprises:

determining whether the current section corresponds to the preheating section or the heating section;

correcting the measured temperature by applying the preheating section temperature correction algorithm based on the current section corresponding to the preheating section; and correcting the measured temperature by applying the heating section temperature correction algorithm based on the current section corresponding to the heating section.

7. The method of claim 6, wherein the selecting of one of the plurality of temperature correction algorithms includes selecting one of the plurality of temperature correction algorithms based on the measured temperature and the current section in which the heater is operating.

8. The method of claim 7, wherein the plurality of sections include a preheating section and a plurality of heating sections, and the plurality of temperature correction algorithms include a preheating section temperature correction algorithm and a plurality of heating section temperature correction algorithms, and the correcting of the measured temperature includes:

correcting the measured temperature by applying the preheating section temperature correction algorithm based on the current section corresponding to the preheating section; and selecting one of the plurality of heating section temperature correction algorithms based on the measured temperature and correcting the measured temperature by applying the selected heating section temperature correction algorithm, based on the current section corresponding to one of the plurality of heating sections.

9. An aerosol generating device comprising:

a heater for heating an aerosol generating material; and a controller configured to measure a temperature of the heater, select one of a plurality of temperature correction algorithms based on the measured temperature, correct the measured temperature by applying the selected temperature correction algorithm so that the measured temperature matches with an actual temperature at which the aerosol generating material is heated, and control power supplied to the heater, based on the corrected temperature, wherein the plurality of temperature correction algorithms include a high-temperature correction algorithm and a low-temperature correction algorithm, and wherein the controller is further configured to:

correct the measured temperature by applying the high-temperature correction algorithm based on the measured temperature being equal to or greater than a preset value, and correct the measured temperature by applying the low-temperature correction algorithm based on the measured temperature being below the preset value.

10. The aerosol generating device of claim 9, wherein the high-temperature correction algorithm adds a first constant to the measured temperature, and the low-temperature correction algorithm adds a second constant to the measured temperature.

11. The aerosol generating device of claim 9, further comprising a heat transfer object, wherein heat generated from the heater is transferred to the aerosol generating device through the heat transfer object, and wherein the plurality of temperature correction algorithms are determined based on a difference between the temperature of the heater and a temperature of the heat transfer object.

12. The aerosol generating device of claim 9, wherein the plurality of temperature correction algorithms are represented by a polynomial or a constant.

13. An aerosol generating device comprising:

a heater for heating an aerosol generating material; and a controller configured to measure a temperature of the heater operating in an operation section including a plurality of sections, determine, from among the plurality of sections, a current section in which the heater is operating, select one of a plurality of temperature correction algorithms based on the current section, correct the measured temperature by applying the selected temperature correction algorithm so that the measured temperature matches with an actual temperature at which the aerosol generating material is heated; and control power supplied to the heater based on the corrected temperature, wherein the plurality of sections include a preheating section and a heating section, and the plurality of temperature correction algorithms include a preheating section temperature correction algorithm and a heating section temperature correction algorithm, and wherein the controller is further configured to:

determine whether the current operation section of the heater corresponds to the preheating section or the heating section, correct the measured temperature by applying the preheating section temperature correction algorithm based on the current section corresponding to the preheating section, and correct the measured temperature by applying the heating section temperature correction algorithm based on the current section corresponding to the heating section.

14. The aerosol generating device of claim 13, wherein the controller selects one of the plurality of temperature correction algorithms, based on the measured temperature and the current section in which the heater is operating.

15. The aerosol generating device of claim 14, wherein the plurality of sections include a preheating section and a plurality of heating sections, and the plurality of temperature correction algorithms include a preheating section temperature correction algorithm and a plurality of heating section temperature correction algorithms, and the controller is further configured to:

correct the measured temperature by applying the preheating section temperature correction algorithm based on the current section corresponding to the preheating section, and select one of the plurality of heating section temperature correction algorithms based on the measured temperature, and correct the measured temperature by applying the selected heating section temperature correction algorithm, based on the current section corresponding to one of the plurality of heating sections.

* * * * *